US005516197A

United States Patent [19]

Condos

[11] Patent Number: 5,516,197

[45] Date of Patent: May 14, 1996

[54] CHAIR

[76] Inventor: Jim Condos, 39 Mermaid Ave., Lurline Bay, New South Wales, 2035, Australia

[21] Appl. No.: 312,152

[22] Filed: Sep. 23, 1994

[51] Int. Cl.[6] ..... A47C 1/02

[52] U.S. Cl. ..... 297/344.18; 297/383

[58] Field of Search ..... 297/344.18, 344.12, 297/239, 353, 383; 248/188.2, 188.8, 188.5, 172, 188

[56] References Cited

U.S. PATENT DOCUMENTS

| | | | |
|---|---|---|---|
| 1,713,034 | 5/1929 | Denson et al. | 297/344.18 X |
| 2,626,118 | 1/1953 | Rice | 248/188.5 X |
| 2,746,822 | 5/1956 | Copenhaver | 248/188.5 |
| 3,720,443 | 3/1973 | Mourgue | 297/383 |
| 3,855,646 | 12/1974 | Glickman | 297/383 X |
| 3,858,935 | 1/1975 | Pask | 297/383 X |
| 4,170,382 | 10/1979 | Wheeler . | |

FOREIGN PATENT DOCUMENTS

| | | | |
|---|---|---|---|
| 1095395 | 3/1980 | Canada . | |
| 2477855 | 3/1980 | France . | |
| 1946083 | 3/1971 | Germany . | |
| 1395381 | 5/1975 | United Kingdom | 297/383 |

*Primary Examiner*—Laurie K. Cranmer
*Attorney, Agent, or Firm*—Hamilton, Brook, Smith & Reynold

[57] ABSTRACT

An adjustable chair is disclosed having at least one pair of front or back legs and at least one other leg. Each leg of the pair includes a hollow sleeve and a strut telescopically moveable within the sleeve to shorten or lengthen the leg. A flexible compression member is restrained within the sleeve and connected at one end to its respective strut and at the other to an adjustment means for selectively adjusting the length of each leg.

4 Claims, 5 Drawing Sheets

CHAIR

The present invention relates to chairs and in particular to a chair that is easily adjustable.

Preferably the chair includes adjustments for both seat height or angle and also for backrest position, although it is not essential for both these features to be present together.

The preferred form of chair includes three or four legs and is particularly suited to stacking. Previously known height-adjustable chairs have required a single centrally located pedestal leg and this has precluded stackability.

According to the invention there is provided an adjustable chair having at least one pair of front or back legs and at least one other leg, each leg of at least said pair including a hollow sleeve and a strut telescopically movable within the sleeve to shorten or lengthen the leg, a flexible compression member restrained within said sleeve and connected at one end to its respective strut and at the other to an adjustment means for selectively adjusting the length of each leg.

Preferably, the compression members of both legs of said pair are interconnected by common adjustment means for simultaneously adjusting both legs of the pair.

Preferably also, the chair includes two pairs defining four legs arranged to permit a series of like chairs to nestably stack one above the other.

Preferably also, the adjustable chair includes a fore-and-aft adjustable backrest, the backrest being secured to the chair frame by a support strut hingedly mounted to the frame, a spring-loaded sliding link connected to the support strut by an intermediate link thereby to bias the backrest towards a forward position, an actuating lever having a handle portion at one end and hinged at the other to the frame, said lever being connected intermediate its ends to the sliding link, and selectively engageable with a locking means defining a plurality of positions for the back rest.

A preferred embodiment of the invention will now be described, by way of example only, with reference to the accompanying drawings in which.

Figure 1:
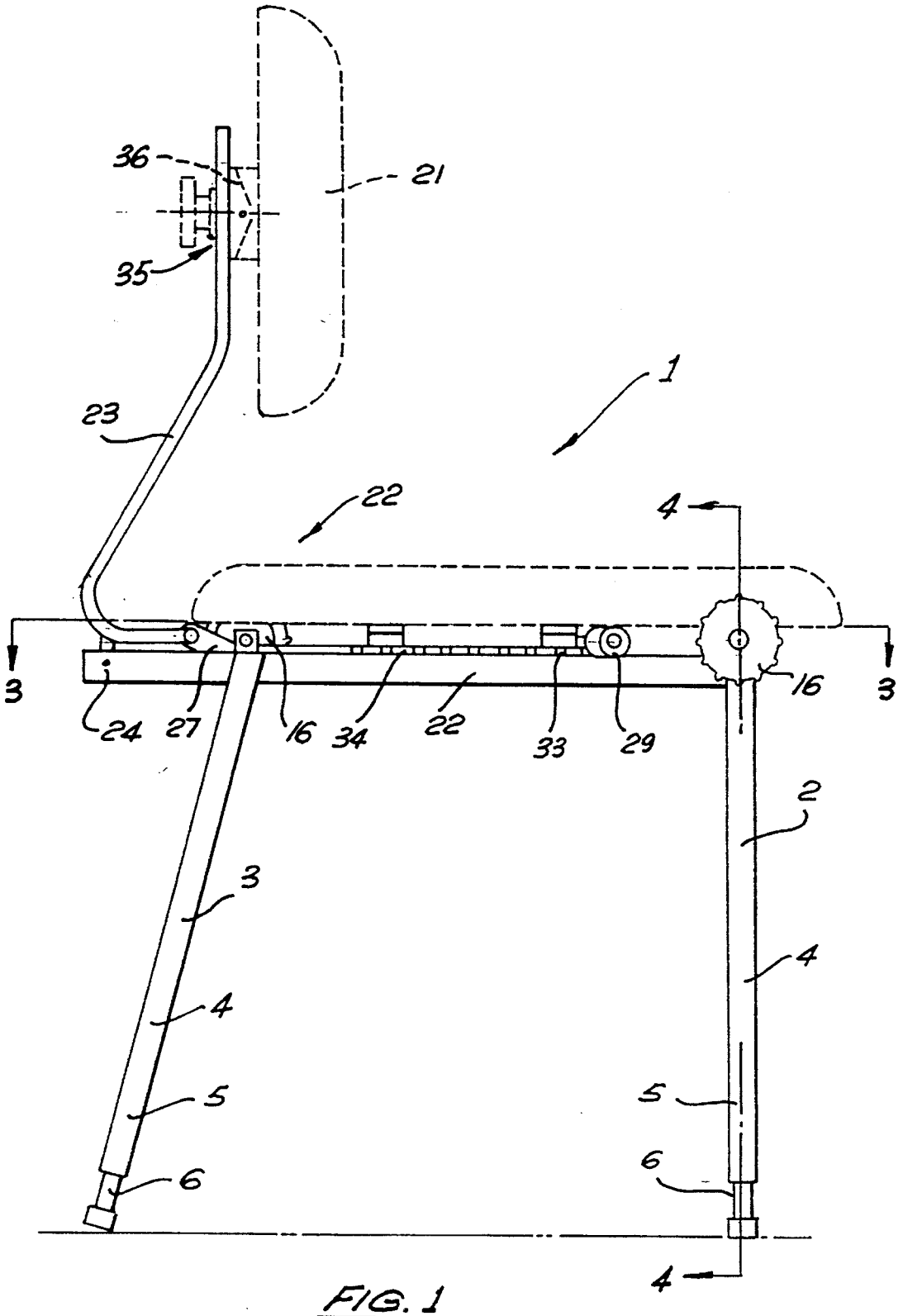
FIG. 1 is a schematic side view of a stackable chair incorporating both height and backrest adjustment.
Figure 2:
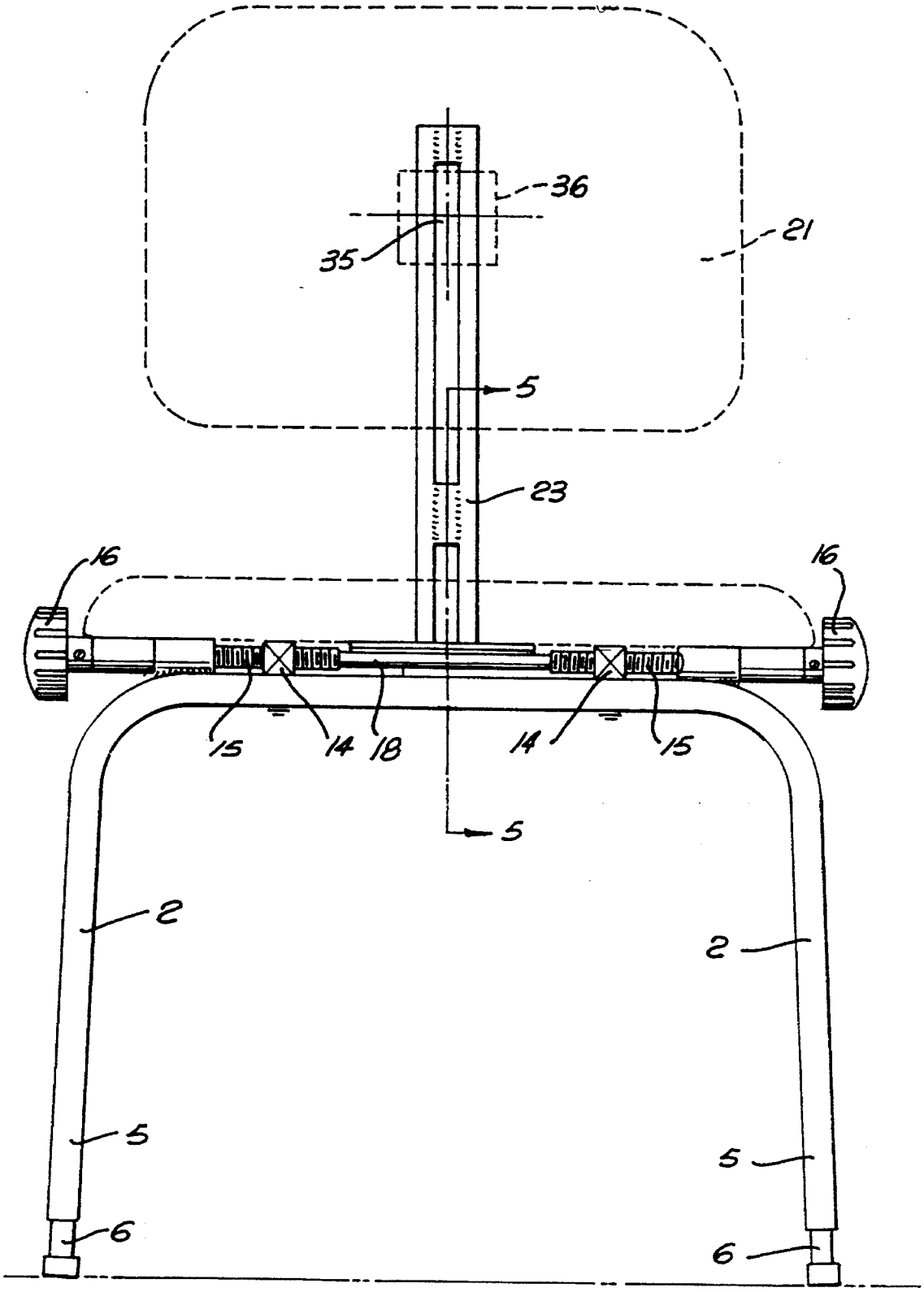
FIG. 2 is a front view of the chair shown in FIG. 1.

Referring to the drawings, the chair 1 includes two pairs 2 and 3 of front and back legs respectively. Each leg 4 includes a hollow sleeve 5 and a strut 6 telescopically movable within its sleeve 5 to shorten or lengthen the leg. A flexible compression member 7 is restrained within each sleeve and connected at its lower end 8 to its respective strut 6 and at its upper end 9 to an adjustment means for selectively adjusting the length of each leg.

Figure 4:
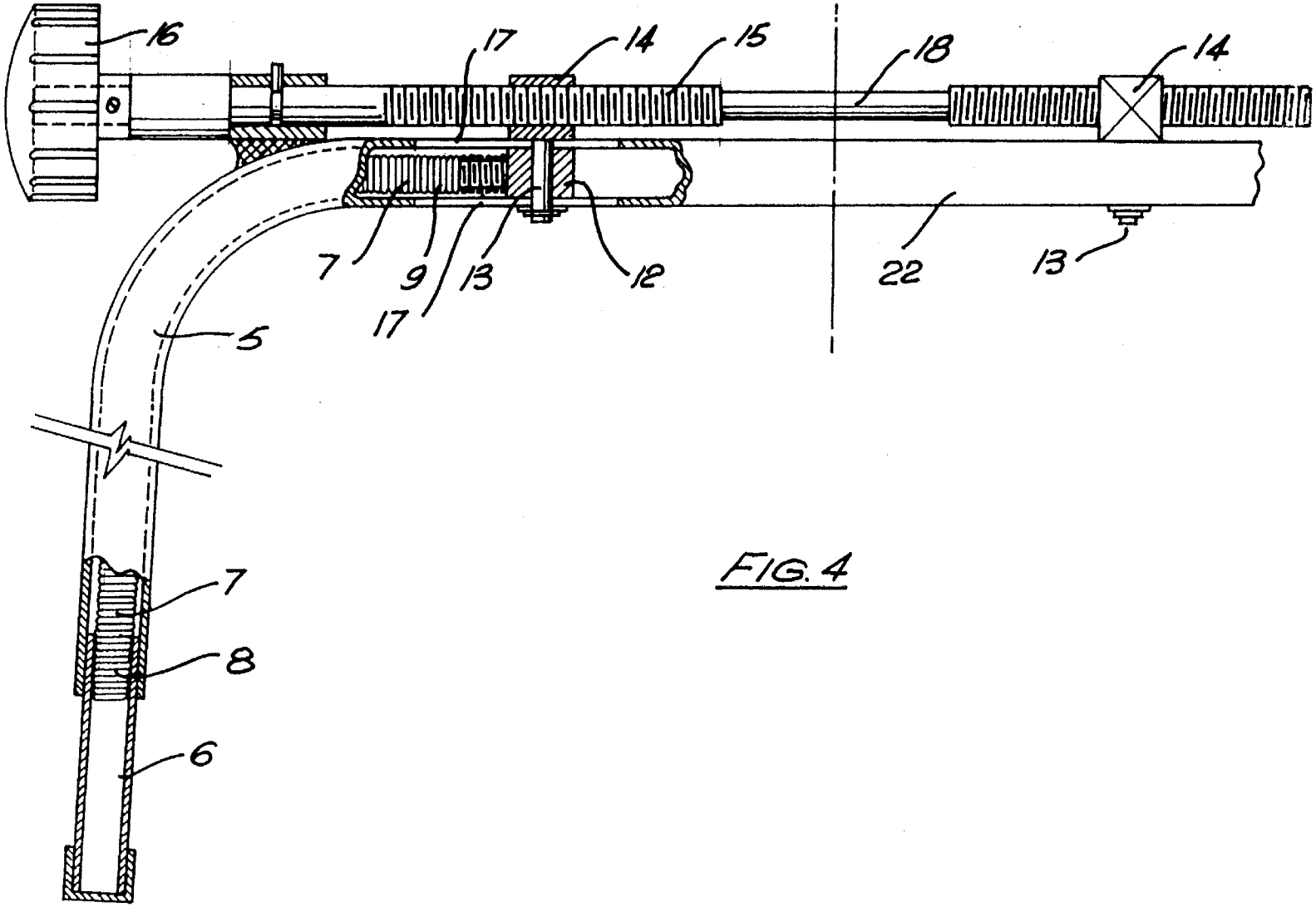
FIG. 4 is an enlarged part front sectional elevation of one of the front pair of legs.

As best shown in FIG. 4 each compression member 7 is a tightly wound spring which is swaged to the strut and threadedly connected at its upper end 9 to a slider block 12 movable within the sleeve 5. The slider blocks 12 are each connected via a pin 13 to a sliding nut 14 which engages a screw thread 15 rotatable by means of knob 16. Sleeve 5 has upper and lower slots 17 to accommodate the sliding mechanism.

In the preferred form illustrated, each pair of legs are simultaneously adjusted by opposite handed screw threads mounted on a common shaft 18. Rotating the knob 16 selectively draws the nuts 14 inwardly or outwardly thereby to extend or retract their respective struts and shorten or lengthen the legs.

Figure 3:
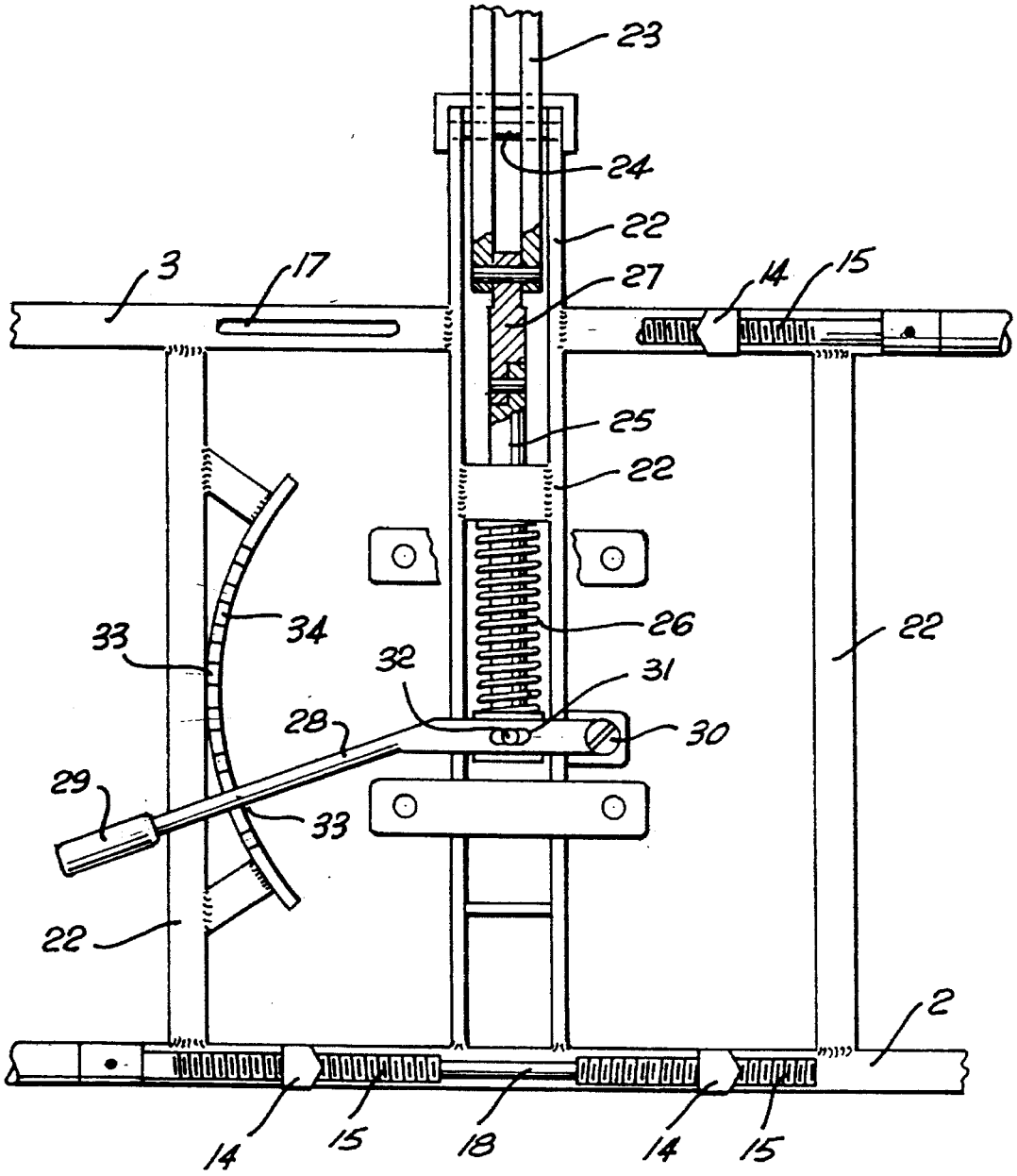
FIG. 3 is a plan view of the chair with the seat removed to better illustrate the operating mechanism.
Figure 5:
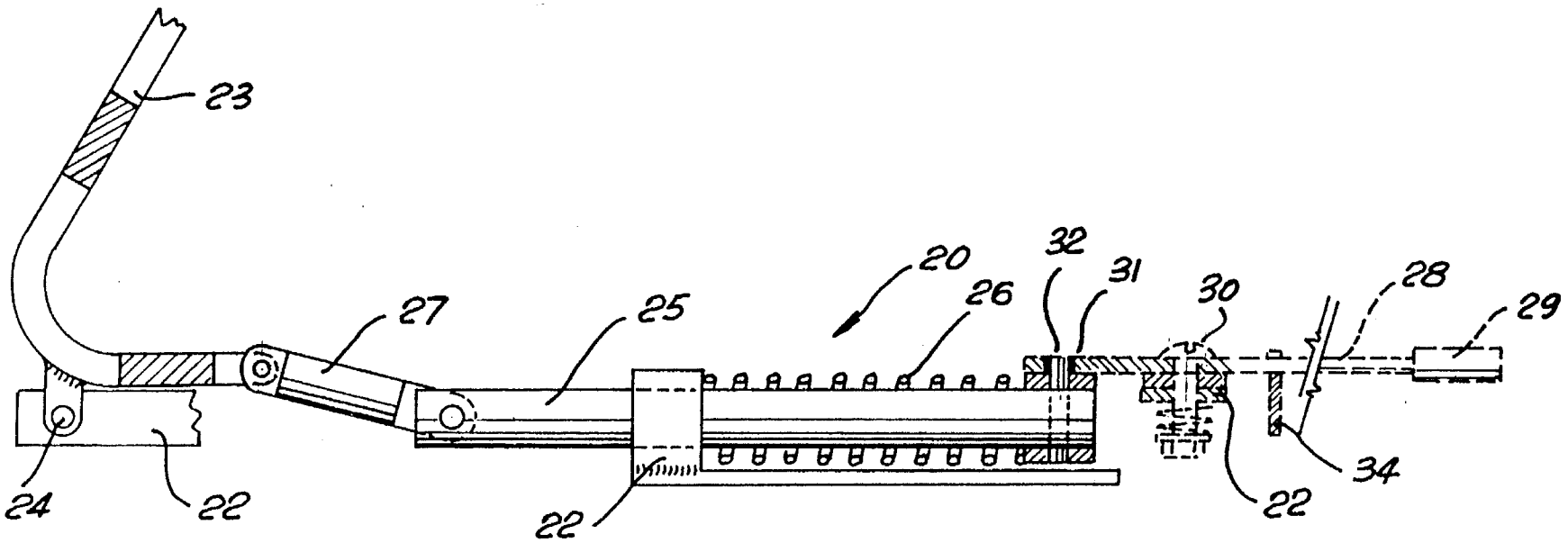
FIG. 5 is an enlarged sectional view taken on line 5—5 of FIG. 2.

The preferred embodiment illustrated also includes a fore-and-aft adjustable backrest mechanism 20 as shown in FIGS. 3 and 5. The backrest 21 is secured to the chair frame 22 by a support strut 23 hingedly mounted to the frame at 24. A sliding link 25 is spring-loaded against the frame 22 by compression spring 26 and connected to the support strut 23 via an intermediate link 27, thereby to bias the backrest 21 towards a forward position with respect to the frame. The backrest is adjusted by an actuating lever 28 having a handle 29 at one end and hinged at the other end 30 to the frame 22. The actuating lever 28 is connected intermediate its ends to the sliding link 25 by means of a slot 31 in the lever engageable with a pin 32 projecting from the sliding link. The lever can be selectively moved to any one of a plurality of backrest positions defined by retaining slots 33 formed in a quadrant 34. Limited vertical movement of the actuating lever permits movement between these slots.

The backrest 21 is hingedly connected to the support strut 23 at 35 by a spring-loaded bracket 36 permitting limited clockwise rotation against the spring bias when viewed in the configuration of FIG. 1.

It will be apparent that the rearwardly divergent orientation of the legs permits a series of like chairs to nestably stack one above the other. In some embodiments the chair legs may be individually adjustable. In other embodiments the number of legs can be varied. For example, in one embodiment a chair includes a pair of front less as illustrated but with a single back leg. Conversely, a single front leg may be employed with a pair of back legs.

Although the invention has been described with reference to specific examples, it will be appreciated by those skilled in the art that the invention may be embodied in many other forms.

I claim:

1. An adjustable chair having at least one pair of front or back legs and at least one other leg, each leg of at least said pair including a hollow sleeve and a strut telescopically movable within the sleeve to shorten or lengthen the leg, a flexible compression member restrained within said sleeve and connected at one end to its respective strut and at the other to an adjustment means for selectively adjusting the length of each leg and said adjustment means including a slider block moveable within the sleeve in response to rotation of a screw thread.

2. An adjustable chair having at least one pair of front or back legs and at least one other leg, each leg of at least said pair including a hollow sleeve and a strut telescopically movable within the sleeve to shorten or lengthen the leg, a flexible compression member restrained within said sleeve and connected at one end to its respective strut and at the other to an adjustment means for selectively adjusting the length of each leg, the compression members of both legs of said pair being interconnected by a common adjustment means for simultaneously adjusting both legs of the pair, and said common adjustment means including a common shaft, each pair of legs being simultaneously adjusted by opposite handed screw threads mounted on the common shaft.

3. An adjustable chair having at least one pair of front or back legs and at least one other leg, each leg of at least said pair including a hollow sleeve and a strut telescopically movable within the sleeve to shorten or lengthen the leg, a flexible compression member restrained within said sleeve and connected at one end to its respective strut and at the other to an adjustment means for selectively adjusting the length of each leg, said adjustment means including a slider block moveable within the sleeve in response to rotation of a screw thread, and wherein the flexible compression member is a spring.

4. An adjustable chair having at least one pair of front or back legs and at least one other leg, each leg of at least said pair including a hollow sleeve and a strut telescopically movable within the sleeve to shorten or lengthen the leg, a flexible compression member restrained within said sleeve and connected at one end to its respective strut and at the other to an adjustment means for selectively adjusting the length of each leg, said chair further including a fore-and-aft adjustable backrest, the backrest being secured to the chair frame by a support strut hingedly mounted to the frame, a spring-loaded sliding link connected to the support strut by an intermediate link thereby to bias the backrest towards a forward position, an actuating lever having a handle portion at one end and hinged at the other to the frame, said lever being connected intermediate its ends to the sliding link, and selectively engageable with a locking means defining a plurality of positions for the backrest.

* * * * *